US005604633A

United States Patent [19]

Christianson

[11] Patent Number: 5,604,633

[45] Date of Patent: Feb. 18, 1997

[54] CONDENSATION-FREE SHOWER MIRROR HEATED BY HOT SHOWER STREAM

[75] Inventor: Thomas R. Christianson, Napa, Calif.

[73] Assignee: ShowerTek, Inc., Napa, Calif.

[21] Appl. No.: 542,038

[22] Filed: Oct. 12, 1995

Related U.S. Application Data

[63] Continuation of Ser. No. 271,107, Jul. 6, 1994, abandoned.

[51] Int. Cl.[6] ..... G02B 5/08; G02B 7/182

[52] U.S. Cl. ..... 359/507; 359/509; 359/512; 359/514; 4/597; 4/605

[58] Field of Search ..... 359/507, 509, 359/512, 513, 514; 4/597, 605

[56] References Cited

U.S. PATENT DOCUMENTS

| | | | |
|---|---|---|---|
| 392,466 | 11/1888 | Shurtleff | 248/419 |
| 3,530,275 | 9/1970 | Rust | 219/219 |
| 3,708,218 | 1/1973 | Smillie, III | 359/512 |
| 4,072,397 | 2/1978 | Ross | 350/61 |
| 4,150,869 | 4/1979 | Hansen | 350/61 |
| 4,556,298 | 12/1985 | Gottlieb | 350/588 |
| 4,836,668 | 6/1989 | Christianson | 350/588 |
| 4,852,986 | 8/1989 | Yu | 359/865 |
| 4,904,072 | 2/1990 | Christianson | 359/512 |
| 4,906,084 | 3/1990 | Christianson | 359/514 |
| 4,993,821 | 2/1991 | Christianson | 359/512 |
| 5,032,015 | 7/1991 | Christianson | 359/512 |

*Primary Examiner*—Ricky D. Shafer

*Attorney, Agent, or Firm*—David Pressman; John S. Heyman

[57] ABSTRACT

A condensation-free shower mirror includes a mirror (10) enclosed by a housing (12). The housing is attached to one end of a positionable arm (16), which has a C-clip (17) at another end for clipping onto a water pipe (18) of a shower head (19). The rear surface of the mirror has a protective coating or backing. Prior to shaving or other use, the mirror is positioned in a hot shower stream (20) to be heated. When the mirror is heated above the dew point of water, it will become free of condensation, and can be used for shaving or grooming, either with the hot water continuing to flow onto its rear surface, or after it is moved away from the water spray. After use, it can be easily positioned away from the shower stream so that the user can resume normal showering. The mirror can be easily detached from the pipe and easily clipped onto another, so that it can be used in different hotel rooms when traveling, as well as in the home.

18 Claims, 1 Drawing Sheet

CONDENSATION-FREE SHOWER MIRROR HEATED BY HOT SHOWER STREAM

This application is a continuation of application Ser. No. 08/271,107 filed Jul. 6, 1994, now abandoned.

BACKGROUND

1. Field of Invention

This invention relates generally to mirrors, specifically to a portable, condensation-free mirror for use in a bathroom, shower, or other steamy environment.

2. Prior Art

Many men prefer to shave while showering or bathing, because a closer shave can be achieved when the beard is softened by the steam and hot water, and the shaving cream and shavings can be conveniently rinsed away. Many women like to apply skin treatments immediately after a hot shower while their skin is still moist and soft. Such grooming cannot be done in front of a conventional mirror, because in a steamy bathroom, a thick layer of condensation will form on the cold mirror to completely obscure it.

Condensation-free mirrors have been designed to allow grooming in steamy bathrooms. My U.S. Pat. Nos. 4,836,668 (1989); 4,904,072 (1990); 4,906,084 (1990); 4,993,821 (1991); and 5,032,015 (1991); show mirrors each of which has an adapter that mounts between the end of a water supply pipe and a shower head: it is installed by removing the shower head from the pipe, screwing one end of the adapter onto the pipe, then threading the shower head on the other end of the adapter. A wrench may be needed for tightening the parts to ensure water-tight fits. A hollow, bendable arm extending between the adapter and the mirror diverts a small stream of hot water from the pipe to a chamber behind the mirror to heat it above the dew point of water, thus preventing condensation on the mirror and keeping it clear. The position of the mirror can be adjusted by bending the arm.

Although its installation is simple, people who are adverse to mechanical work will be reluctant to perform the operation. Moreover, it cannot be conveniently moved from one shower to another, as a traveler may desire when staying in hotels not equipped with such a mirror.

My copending application—Ser. No. 08/136,682, filed Oct. 14, 1993—shows a portable shower mirror with a bladder which can be filled with hot water to keep the mirror free of condensation. However, this requires extra steps to open, fill, and seal the bladder.

OBJECTS AND ADVANTAGES

Accordingly, several objects of the invention are to provide a condensation-free mirror which can be very easily mounted on the water pipe of a shower head without using any tools or detaching the shower head, which can be easily heated for preventing condensation thereon and kept clear, which can be easily positioned for shaving or other use, which can be positioned out of the way when not needed, and which can be used immediately without having to open any caps, fill any bladders, etc.

Other objects and advantages of the invention are to provide a condensation-free mirror which is highly portable so that it can be conveniently carried and mounted in any shower stall when traveling; and which is easy and economical to manufacture.

Further objects and advantages will become apparent from a study of the following description and the accompanying drawings.

BRIEF DESCRIPTION OF THE DRAWING FIGURES

DRAWING REFERENCE NUMERALS

10. Mirror
11. Silvered Side
12. Housing
13. Frame
14. Back Plate
15. Gasket
16. Positionable Arm
17. C-Clip
18. Water Pipe
19. Shower Head
20. Hot Shower Stream

SUMMARY OF THE INVENTION

A condensation-free shower mirror includes an acrylic mirror attached to one end of a bendable or positionable arm. A C-clip attached to the other end of the arm clips onto the water pipe of a shower head. The bendable arm allows the mirror to be easily set in any desired position. Prior to shaving or other use, the mirror is positioned in the hot shower stream to heat it above the dew point of water to prevent condensation and keep it clear. The mirror can be easily positioned away from the shower stream after use.

Figure 2:
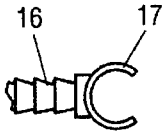
FIG. 2 is a front view of a C-clip of the mirror.
Figure 1:
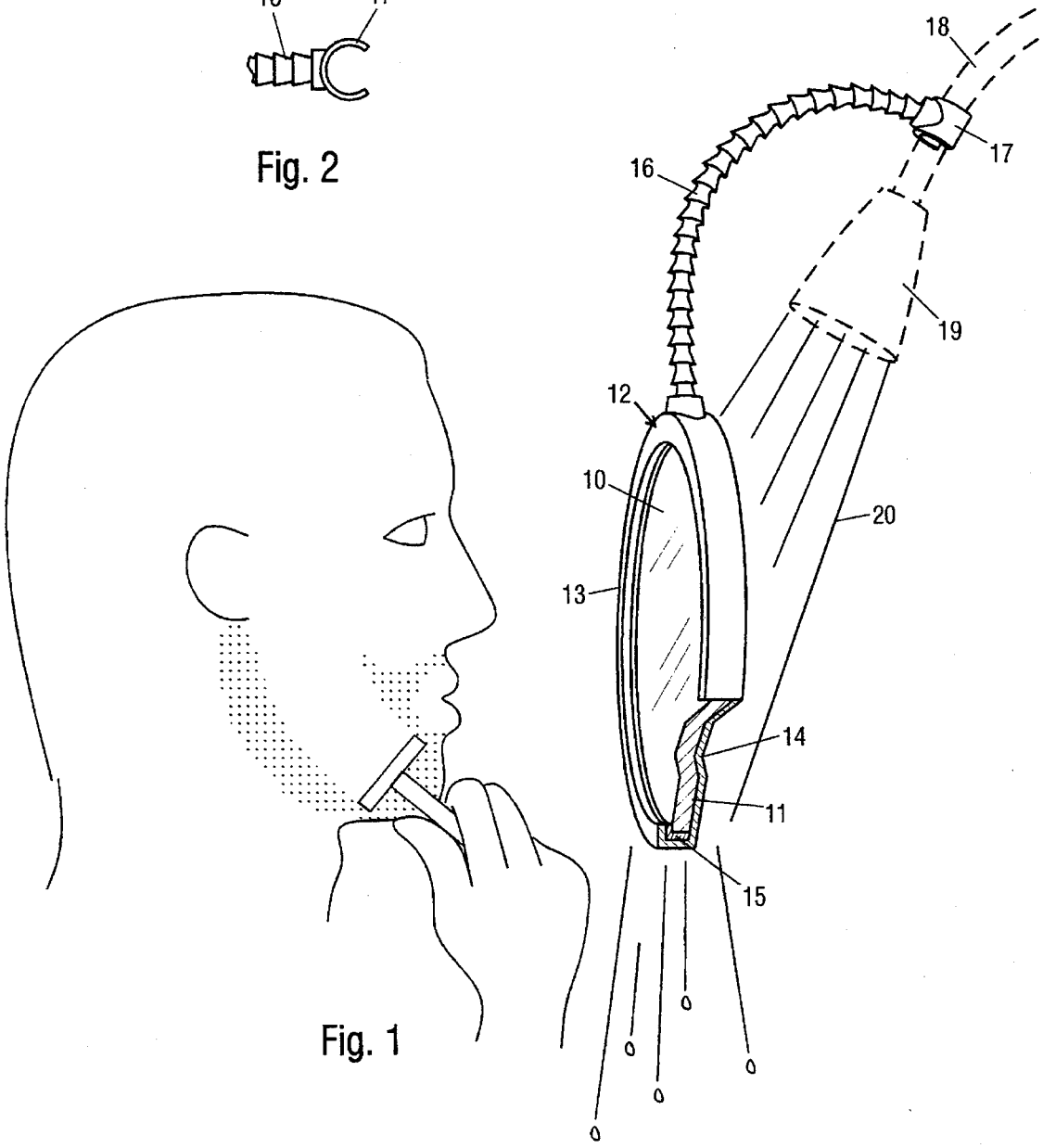
FIG. 1 is a side perspective and partial sectional view of man shaving while using a condensation-free mirror heated by a hot shower stream in accordance with a preferred embodiment of the invention.

Description —FIGS. 1 and 2

In accordance with a preferred embodiment of the invention as shown in FIG. 1, a condensation-free shower mirror includes a round acrylic mirror 10 with a silvered side 11. A plastic housing 12 includes a ring-shaped frame 13 (about 17 cm in outside diameter) enclosing the edge of mirror 10, and a disc-shaped back plate 14 (preferably of Mylar plastic film, made by E. I. dupont de Nemours & Co., Wilmington, Del., as shown in my above U.S. Pat. No. 4,906,084 covering silvered side 11. An annular rubber gasket 15 having an L-shaped cross section is pressed between the edge of mirror 10 and frame 13 to provide a water-tight seal and protect silvered side 11 from water damage. The entire surface of silvered side 11 is in contact with back plate 14. Mirror 10 is attached to one end of a "goose neck" or positionable arm 16, which is easily bendable, but will hold its position when released. Preferably arm 16 (about 25 cm long) is made of multiple ball-and-socket sections, such as the arms sold under the trademark Lock-Line, by Lock-Line Products, Inc., Lake Oswego, Oreg. The opposite end of arm 16 has a plastic C-clip or clamp 17 for easy but secure clipping onto a water pipe 18 of a shower head 19. Preferably C-clip 17, a front view of which is shown in FIG. 2, has a diameter of 20 mm, a chorded gap of 18 mm, and is 30 mm long. C-clip 17 may be lined on its inner surface with friction tape or a material with a high coefficient of friction (not shown) for preventing the clip from turning on the shower arm.

Installation And Operation

The shower mirror can be easily attached to the pipe of any shower head by simply snapping C-clip 17 thereon, without using any tools or detaching the shower head. Positionable arm 16 allows mirror 10 to be easily set in any desired position. Prior to shaving or other use, mirror 10 is positioned as shown in front of a hot shower stream 20, which heats back plate 14. Because back plate 14 is in thermal contact with the entire surface of silvered side 11, mirror 10 is also heated. When mirror 10 is heated above the dew point of water, it will become free of condensation and ready for use.

If shower head 19 is low enough, the user can shave or otherwise use the mirror while it is continuously heated by water 20 as indicated. For this purpose arm 16 can be bent over water 20 as shown, or around the side of water 20 (not shown). Alternatively, and especially if shower head 19 is high, arm 16 can be positioned in front of water 20 for a minute or so to heat the mirror, whereafter it can be bent into a convenient position for shaving or other use.

When not needed, mirror 10 can be positioned away from shower stream 20, so that the user can resume showering.

The shower mirror can be easily detached from water pipe 18, and arm 16 can be bent into a compact shape for storage or transportation in luggage. The shower mirror can be carried to hotels and set up in shower stalls therein. Its ease of installation and transportation make the shower mirror suitable for travel, as well as home use.

Summary, Ramifications, and Scope

Accordingly the reader will see that I have provided an improved condensation-free shower mirror. It is very easy to install onto a water pipe without using any tools or detaching a shower head. It can be easily positioned in front of a hot shower stream for heating and preventing condensation thereon. It can be easily positioned away after use so that it will not impede normal showering. It is very easy to carry and setup in any bathroom, shower, or other steamy environment, so that in addition to home use, it is also very convenient for travelers.

Although the above descriptions are specific, they should not be considered as limitations on the scope of the invention, but only as an example of the preferred embodiment. Many other ramifications and variations are possible within the teachings of the invention. For example, the mirror can be made of glass instead of acrylic. The mirror and its frame can be rectangular or any other shape, and can be made of materials other than plastic. The frame can even be eliminated if the positionable arm is attached directly to the mirror, e.g., by clamps or adhesive, and the silvered side is protected from water by a suitable waterproof coating, such a plastic dip. In lieu of a thin coating, a heavy, thick backing (which can hold a large quantity of heat) may be used to absorb more heat and thus keep mirror 10 fog free for a longer time after a single heating. Other types of positionable arms can be used, such as a coiled metal gooseneck arm, a bendable wire (optionally coated with vinyl), an articulated arm with hinged sections, etc. The arm can also be attached to a shower wall or shower curtain rod by a suction cup, clamps, screwing or gluing a plate, etc. The front surface of mirror 10 may be coated with an anti-condensation coating, such as the Anti-Fog Coating sold by Ram Products, Sturgis, Mich.; this coating is sprayed or deposited on the mirror and is cured by baking or UV light. If mirror 10 has an anti-condensation coating, and/or the shower is well ventilated, the mirror may remain fog-free on its own, so that it may not be necessary to heat the mirror with hot water, either before or while using it.

Instead of a C-clip, other types of hardware can be used for attaching the arm to the water pipe, such as a spring-loaded clamp, a C-clamp with a tightening screw, etc. The arm can be made extendible by providing telescoping or scissoring sections. The rubber gasket can be replaced with a suitable sealant, such as silicone. Therefore the reader is requested to determine the scope of the invention by the appended claims and their legal equivalents, and not by the examples given.

I claim:

1. A shower mirror assembly comprising:

a mirror having front and rear surfaces, said front surface being a reflecting surface, said rear surface being in thermal contact with said front surface such that hot water from a shower stream applied to said rear surface will be conducted to heat and be retained by said front surface sufficiently to keep said front surface fog-free in a steamy shower environment for a predetermined time period, even when said mirror is no longer in front of said shower steam, an elongated postionable arm comprising a continuous elongated bendable member, said member having distal and proximal opposite ends, said distal end being connected to said mirror to support said mirror, said arm being easily bendable to any position within a range of different positions, but able to stay in a chosen position when released, and attaching means for securely attaching said proximal end of said continuous elongated bendable member to a stationary object, said attaching means comprising a fixed C-shaped clip, said fixed C-shaped clip having predetermined dimensions so that it can be snapped onto a shower head supply arm having a predetermined diameter, rotated to any circumferential position on said supply arm and removed from said shower head supply arm, said continuous elongated bendable member being long and flexible enough so that when said fixed C-shaped clip is attached to said shower head arm adjacent a shower head, said mirror can be positioned so that said rear surface can either (a) be moved to a first position in front of said shower head so that the hot water stream from said shower head will flow onto said rear surface for immediate fog-free use, or (b) can be moved to a second standby position away from said shower head for either storage or for further fog-free use during said predetermined time period.

2. The mirror apparatus of claim 1, further including a housing for holding said mirror, said housing including a front frame and a planar back plate.

3. The mirror apparatus of claim 2, further including sealing means disposed between said mirror and said housing for sealing said rear surface from water.

4. The mirror apparatus of claim 3, wherein said sealing means comprises a gasket.

5. The mirror apparatus of claim 1 wherein said rear surface of said mirror comprises a protective coating or covering.

6. The mirror apparatus of claim 1 wherein said elongated positionable arm comprises a plurality of swivel joints.

7. The mirror apparatus of claim 1 wherein each of said plurality of swivel joints comprises a mated ball and socket.

8. A shower mirror apparatus for use in a steamy environment, comprising:

a mirror having front and rear surfaces, said front surface being a reflecting surface, said rear surface being in thermal contact with said front surface such that hot water from a shower stream applied to said rear surface will be conducted to heat and be retained by said front surface sufficiently to keep said front surface fog-free in a steamy shower environment for a predetermined time period, even when said mirror is no longer in front of said shower stream, an elongated positionable arm comprising a continuous elongated bendable member comprising a plurality of swivel joints, said arm having distal and proximal opposite ends, said distal end being connected to said mirror so as to support said mirror, said arm being easily bendable to a range of different positions, but able to stay in a chosen position when released, and attaching means for securely attaching said proximal end of said continuous elongated bendable member to a stationary object, said attaching means comprising a fixed C-shaped clip, said fixed C-shaped clip having predetermined dimensions so that it can be snapped onto a shower head supply arm having a predetermined diameter, rotated to any circumferential position on said supply arm, and removed from said shower head supply arm, said elongated positionable arm being long and flexible enough so that when said fixed C-shaped clip is attached to said shower head supply arm adjacent a shower head, said mirror can be positioned so that said rear surface can be moved in front of said shower head so that the hot water stream from said shower head will flow onto said rear surface and thereby heat said front surface, whereby said mirror can be easily and stably positioned so that the hot water stream emanating from said shower head will be directed against said rear surface of said mirror, so that said mirror will be heated above the dew point of water for keeping said mirror condensation-free in a steamy environment, and said mirror can be easily moved away to another position away from said hot water stream and positioned stably in said other position for either storage or for further fog-free use during said predetermined time period.

9. The mirror apparatus of claim 8 wherein said continuous elongated bendable member is made of plastic.

10. The mirror apparatus of claim 8, further including a housing for receiving said mirror, said housing including a front frame and a planar back plate.

11. The mirror apparatus of claim 10, further including sealing means disposed between said mirror and said housing for sealing said rear surface from water.

12. The mirror apparatus of claim 11 wherein said sealing means comprises a gasket.

13. The mirror apparatus of claim 8 wherein said rear surface of said mirror comprises a protective coating or covering.

14. The mirror apparatus of claim 8 wherein each of said plurality of swivel joints comprises a mated ball and socket.

15. A method for keeping a mirror free of condensation in a steamy shower environment, comprising:

(a) providing a mirror having front and rear surfaces, said front surface being a reflecting surface, said rear surface being in thermal contact with said front surface such that hot water applied to said rear surface from a shower steam will be conducted to heat and be retained by said front surface sufficiently to keep said front surface fog-free in a steamy shower environment for a predetermined time period, even when said mirror is no longer in contact with said hot water, (b) providing an elongated positionable arm having distal and proximal opposite ends, said distal end being attached to said mirror for supporting said mirror, said elongated arm being a continuous elongated bendable member comprising a plurality of swivel joints so that said arm can easily be bent to any position within a range of different positions, but will stay in a chosen position when released, said elongated positionable arm being long and flexible enough so that when said proximal end is attached to a stationary object adjacent a shower head, said mirror can be moved away from said shower head or in front of said shower head with said rear surface of said mirror in front of said shower head so that a hot water stream from said shower head will flow onto said rear surface and thereby heat said rear surface and hence said front surface of said mirror, (c) providing attaching means on proximal end of said elongated positionable arm for removably attaching said second end of said elongated positionable arm to said stationary object, (d) attaching said attaching means to a shower head supply arm so that said elongated positionable arm and said mirror extend from said supply arm, (e) causing said shower head to spray a hot water therefrom, (f) positioning said mirror so that said rear surface of said mirror is in front of said shower head so that said hot water from said shower head sprays onto said rear surface of said mirror and thereby heats said rear surface of said mirror and hence keeps said front surface of said mirror above the dew point of water and thus keeps said front surface free of condensation, (g) and wherein said attaching means comprises a fixed C-shaped clip which is sized and shaped so that it can be snapped onto and removed from said shower head supply arm of a predetermined diameter, and rotated to any circumferential position on said supply arm.

16. The method of claim 15, further including repositioning said mirror so that said rear surface of said mirror is away from said shower head so that the stream of hot shower emanating from said shower head sprays freely and does not spray onto said rear surface of said mirror, whereby said shower stream can be used directly by a person.

17. The method of claim 15 wherein said attaching means is arranged to removably attach said second end of said elongated positionable arm to the supply arm of said shower head.

18. The method apparatus of claim 17, further including removing said attaching means from said supply arm of said shower head after step (f).

* * * * *